US009421811B2

(12) United States Patent
Hoarau et al.

(10) Patent No.: US 9,421,811 B2
(45) Date of Patent: Aug. 23, 2016

(54) MEDIA BINDER

(75) Inventors: Eric Hoarau, San Francisco, CA (US); Kimberly Ann Pratten, San Diego, CA (US); Gary James Watts, San Diego, CA (US); Keely Van Patten, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 112 days.

(21) Appl. No.: 14/009,054

(22) PCT Filed: Feb. 24, 2012

(86) PCT No.: PCT/US2012/026540

§ 371 (c)(1),
(2), (4) Date: Sep. 30, 2013

(87) PCT Pub. No.: WO2012/166220

PCT Pub. Date: Dec. 6, 2012

(65) Prior Publication Data

US 2014/0079464 A1 Mar. 20, 2014

(30) Foreign Application Priority Data

May 31, 2011 (WO) ..... PCT/US2011/038647
May 31, 2011 (WO) ..... PCT/US2011/038653

(51) Int. Cl.
*B42F 1/00* (2006.01)
*B42F 13/00* (2006.01)
*B42F 9/00* (2006.01)

(52) U.S. Cl.
CPC ..... *B42F 1/006* (2013.01); *B42F 9/008* (2013.01); *B42F 13/002* (2013.01); *B42F 13/0006* (2013.01); *Y10T 29/49826* (2015.01)

(58) Field of Classification Search
CPC ..... B42F 13/0006; B42F 13/002
USPC ..... 402/73–74; 412/3; 281/31
See application file for complete search history.

(56) References Cited

U.S. PATENT DOCUMENTS 2,486,330 A 10/1949 Stanley
3,174,773 A 3/1965 True (Continued)

FOREIGN PATENT DOCUMENTS

CN 2269963 12/1997
CN 2378199 5/2000

(Continued)

OTHER PUBLICATIONS

International Search Report Sep. 30, 2014 issued on Chinese Patent Application No. 201280016461.7 dated Feb. 24, 2012, The State Intellectual Property Office, P.R.

(Continued)

*Primary Examiner* — Kyle Grabowski
(74) *Attorney, Agent, or Firm* — HP Inc. Patent Department

(57) ABSTRACT

A case assembly of a media binder includes a front surface board and a back surface board. Each surface board includes an inwardly facing surface and an outwardly facing surface and a cover sheet, and each cover sheet is wrapped around the outwardly facing surface of one of the surface boards. A marginal edge is attached to the inwardly facing surface of the surface board, and another marginal edge is unattached to the inwardly facing surface of the surface board. An end of the unattached marginal edge includes an extra edge extended from the unattached marginal edge, and the extra edge is folded against the unattached marginal edge. The unattached marginal edge is attached to the inwardly facing surface of an adjacent surface board to form a corner wrap around a corner of the adjacent surface board.

17 Claims, 17 Drawing Sheets

(56) References Cited

U.S. PATENT DOCUMENTS

| | | | | |
|---|---|---|---|---|
| 4,629,349 | A | 12/1986 | Pitts | |
| 4,958,855 | A | 9/1990 | Shipp | |
| 5,876,143 | A | 3/1999 | Ong | |
| 5,938,241 | A | 8/1999 | Wilson | |
| 6,039,494 | A * | 3/2000 | Pearce | B42F 13/0006 402/73 |
| 6,250,867 | B1 | 6/2001 | Gwyn et al. | |
| 6,305,714 | B1 * | 10/2001 | Rossetto | B42F 13/0006 281/29 |
| 7,757,358 | B2 | 7/2010 | Hoarau et al. | |
| 7,798,736 | B2 | 9/2010 | Hoarau et al. | |
| 7,823,927 | B2 | 11/2010 | Hoarau et al. | |
| 7,988,198 | B2 | 8/2011 | Wang | |
| 2002/0135177 | A1 * | 9/2002 | Welch | B42C 7/002 402/73 |
| 2004/0066030 | A1 | 4/2004 | Parker | |
| 2004/0108709 | A1 | 6/2004 | Hengsbach | |
| 2004/0120794 | A1 | 6/2004 | Parker | |
| 2006/0198719 | A1 * | 9/2006 | Parker | B42C 11/04 412/4 |
| 2006/0237961 | A1 | 10/2006 | Partain et al. | |
| 2007/0085329 | A1 | 4/2007 | Silverman | |
| 2007/0086846 | A1 * | 4/2007 | Hough | B42F 13/0053 402/73 |
| 2008/0018089 | A1 * | 1/2008 | Hoarau | B42F 9/008 402/73 |
| 2008/0018090 | A1 | 1/2008 | Hoarau et al. | |
| 2008/0093836 | A1 | 4/2008 | Hoarau et al. | |
| 2008/0175653 | A1 | 7/2008 | Su | |
| 2008/0213032 | A1 | 9/2008 | Aoyama | |
| 2008/0226385 | A1 | 9/2008 | Ruble | |
| 2010/0156085 | A1 | 6/2010 | Devoy et al. | |
| 2010/0158639 | A1 | 6/2010 | Manico et al. | |

FOREIGN PATENT DOCUMENTS

| | | | | |
|---|---|---|---|---|
| CN | 1343570 | | 4/2002 | |
| CN | 2557002 | | 6/2003 | |
| CN | 1506236 | | 6/2004 | |
| CN | 1684841 | | 10/2005 | |
| CN | 2837089 | | 11/2006 | |
| CN | 201169138 | | 12/2008 | |
| CN | 101547797 | | 9/2009 | |
| CN | 201304772 | | 9/2009 | |
| CN | 201511627 | U | 6/2010 | |
| DK | WO 0134404 | A1 * | 5/2001 | B42F 13/0006 |
| FR | 2909923 | | 6/2008 | |
| GB | 1575013 | A | 9/1980 | |
| JP | 11180068 | A | 7/1999 | |
| JP | 2004299364 | | 10/2004 | |
| JP | 2008137370 | | 6/2008 | |
| JP | 2010036568 | | 2/2010 | |
| JP | 2011056781 | | 3/2011 | |
| KR | 20080104654 | | 12/2008 | |
| WO | WO-2009123577 | | 10/2009 | |
| WO | WO-2012/166128 | | 12/2012 | |
| WO | WO-2012/166129 | | 12/2012 | |

OTHER PUBLICATIONS

International Search Report Sep. 25, 2014 issued on Chinese Patent Application No. 201280016469.3 dated Feb. 24, 2012, The State Intellectual Property Office, P.R. China.

International Search Report and Written Opinion dated Feb. 17, 2012 issued on PCT Patent Application No. PCT/US2011/038647 dated May 31, 2011, Korean Intellectual Property Office.

International Search Report and Written Opinion dated Feb. 17, 2012 issued on PCT Patent Application No. PCT/US2011/038653 dated May 31, 2011, Korean Intellectual Property Office.

International Search Report and Written Opinion dated Jan. 2, 2013 issued on PCT Patent Application No. PCT/US2012/026540 dated Feb. 24, 2012, Korean Intellectual Property Office.

* cited by examiner

MEDIA BINDER

CLAIM FOR PRIORITY

The present application is a national stage filing under 35 U.S.C 371 of PCT application number PCT/US2012/026540, having an international filing date of Feb. 24, 2012, which claims priority to PCT application number PCT/US2011/038647, having an international filing date of May 31, 2011, and PCT application number PCT/US2011/038653, having an international filing date of May 31, 2011, the disclosures of which are hereby incorporated by reference in their entireties.

BACKGROUND

As digital cameras gain popularity, the volume of digital pictures taken by users grows rapidly. Although these pictures may be conveniently stored in storage devices, at least some users prefer to store their pictures in a printed format. For those users, a media binder is a desirable option for storing their pictures.

DETAILED DESCRIPTION

The present subject matter is now described more fully with reference to the accompanying figures, in which several examples of the subject matter are shown. The present subject matter may be embodied in many different forms and should not be construed as limited to the examples set forth herein. Rather these examples are provided so that this disclosure will be complete and will fully convey principles of the subject matter.

Traditionally, wrapping corners of a media binder with a cover material requires specialized tools and careful maneuvers in order to achieve a professional appearance. Similarly, processing the cover material of the media binder in order to force the cover material to bend smoothly in the spine area and prevent or reduce crease lines also requires specialized tools and is difficult to perform. Therefore, what are needed are ways to properly wrap corners and process binder covers to prevent or reduce crease lines that are easy to perform and less prone to errors.

Media Binder

Figure 1A:
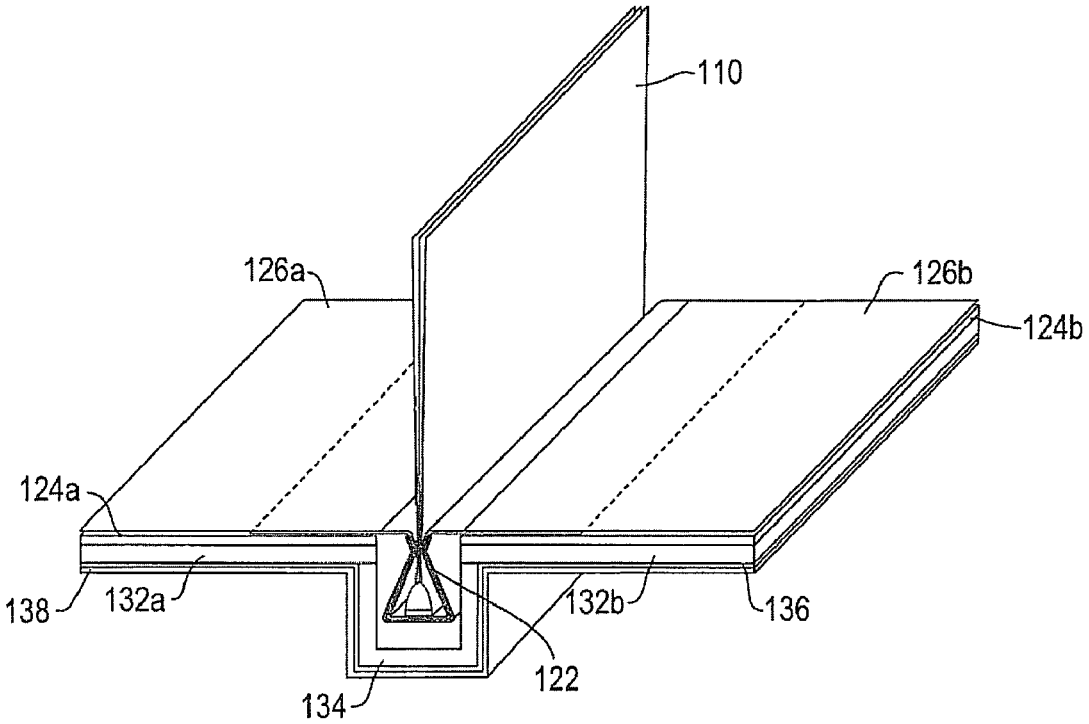
FIG. 1A is a perspective view of an example media binder.
Figure 1B:
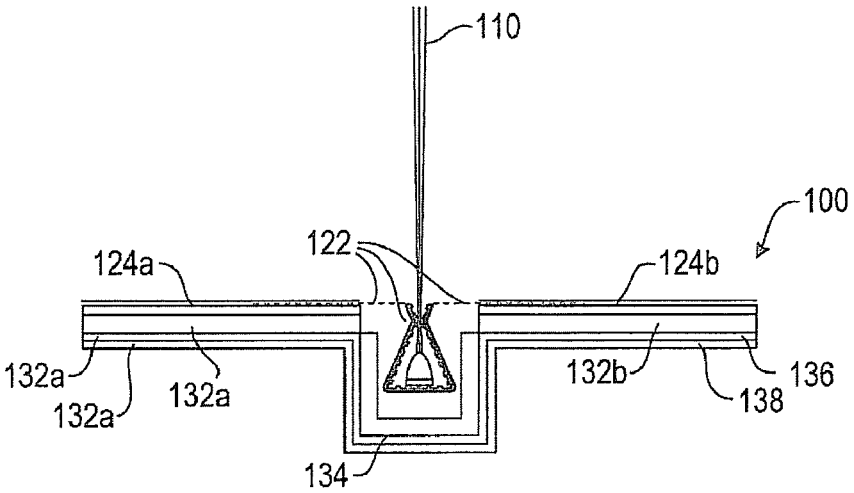
FIG. 1B is a side view of the example media binder shown in FIG. 1A.

FIGS. 1A and 1B show an example of a media binder arrangement (also called a "media binder") 100. In the illustrations, the media binder 100 is opened approximately 180° from a closed position. In this position, physical media 110 inserted in the media binder 100 may be firmly secured in place while being viewed. Examples of the physical media 110 that may be secured in the media binder 100 described herein include photo paper, paper, card stock, business cards, fabric samples, carpet samples, synthetic membranes, acetate sheets, and the like.

The media binder 100 includes two primary components: an inside assembly and a case assembly. The inside assembly includes a front inside board 124*a*, a back inside board 124*b*, a binding mechanism 122, a front paste down 126*a*, and a back paste down 126*b*. The case assembly includes a front surface board 132*a*, a back surface board 132*b*, a spine surface board 134, a binding sheet 136, and a transparent (or semitransparent) cover sheet 138. The inside assembly, the case assembly, and their components will be described in detail below.

In examples disclosed herein, the appearance of the media binder 100 may be customized by adding a custom cover behind the cover sheet 138. The case assembly and the inside assembly can be manufactured in advance (e.g., at a manufacturing site). The customization of the case assembly and the combination of the two assemblies can take place at the client side (e.g., at a retailer site).

Covers of the media binder 100 (e.g., the surface boards 132) may be utilized to enable the user to easily add, remove, and/or replace the physical media 110 in the media binder 100. The binding mechanism 122 secures the physical media 110 inserted in the media binder 100 using forces (e.g., clamping forces of sprint clamps included therein), and the media binder 100 is configured to apply an opening force to the binding mechanism 122 to overcome the forces when the binder covers are opened. For example, when the media binder 100 is opened from a first position greater than approximately 270° to a second position at approximately 360°, an opening force is applied to the binding mechanism 122, causing it to release any physical media 110 secured therein.

Inside Assembly

Figure 2:
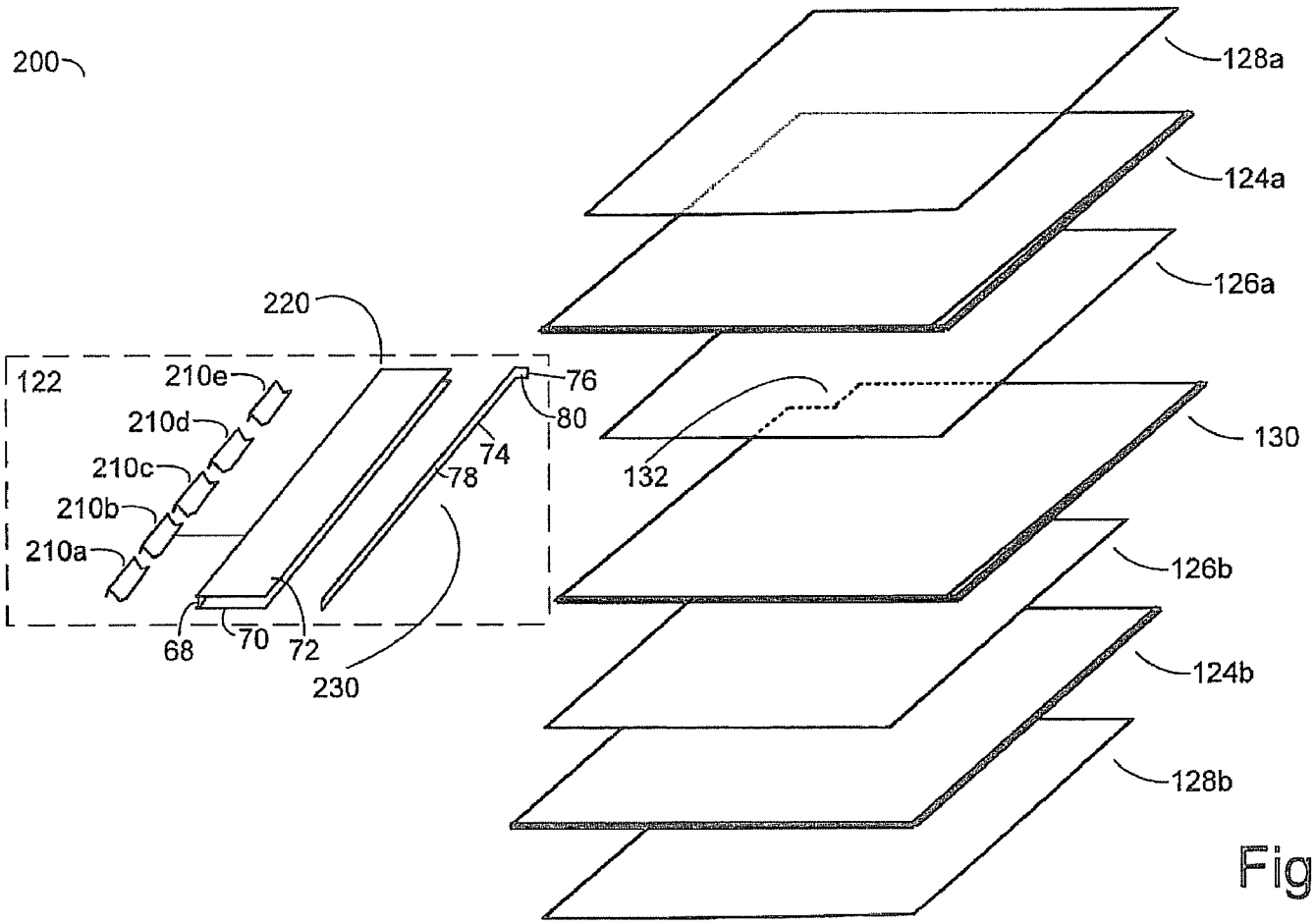
FIG. 2 is an exploded view of an example inside assembly.
Figure 3A:
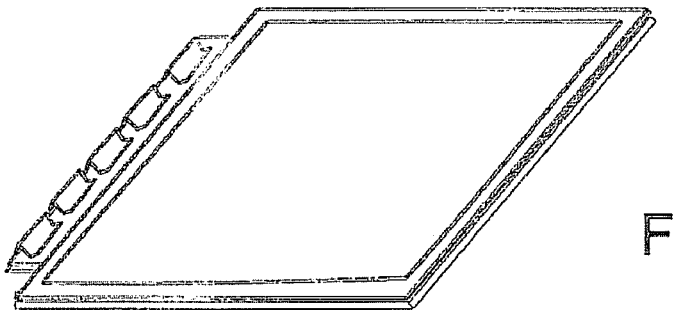
FIG. 3A is a perspective view of the example inside assembly shown in FIG. 2.
Figure 3B:
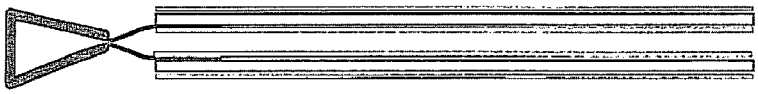
FIG. 3B is a cross sectional view of the example inside assembly shown in FIG. 2.

FIG. 2 shows an exploded view of an example of an inside assembly 200 that includes a binding mechanism 122, a front inside board 124*a*, a back inside board 124*b*, a front paste down 126*a*, a back paste down 126*b*, a front release liner 128*a*, a back release liner 128*b*, and an alignment board 130. The binding mechanism 122 functions to align the physical media 110 within the media binder 100 and securely hold the physical media 110 in place. The binding mechanism 122 includes one or more spring clamps (also called "spine clamps") such as spine clamps 210*a*, 210*b*, 210*c*, 210*d*, 210*e*, a tension sheet 220, and a datum alignment member 230. FIG. 3A and FIG. 3B are a perspective view and a cross sectional view of the inside assembly 200 assembled using the components shown in FIG. 2, respectively.

A spine clamp 210 is a fastening device that operates to securely hold the physical media 110 inserted between clamping surfaces of the spine clamp 210 in place. A spine clamp 210 may be configured to provide a clamping force to accommodate one or more sheets or pages of the physical media 110 such that the physical media 110 may be retained as the media binder 100 is being handled. Examples of the clamping force range between 0.1 and 5 pound-force ("lb") per linear inch of clamping surface. The clamping force may be measured by measuring the force needed to open the spine clamp 210 by pulling at the edges of the clamp where the clamping surfaces meet.

Figure 4:
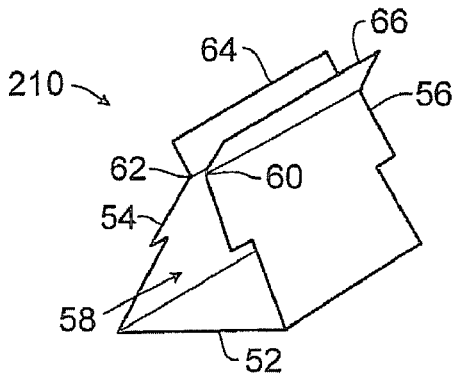
FIG. 4 is a perspective view of an example spine clamp.

FIG. 4 shows an example spine clamp 210 in which the opposing terminal ends of the clamping sides 54, 56 have respective edge features 64, 66. In this example, the spine clamps 210 is formed of a rectangular sheet of material (e.g., spring steel, sheet metal, or a resilient polymeric material) that is bent along two parallel fold lines to form a backside 52 and two clamping sides 54, 56, which have inner surfaces that define a respective holding volume (the "interior cavity") in the shape of a triangular cylinder and operable to receive the physical media 110. The opposing terminal ends of the clamping sides 54, 56 have clamping surfaces, which hold the physical media 110 inserted therebetween. The edge features 64, 66 are outwardly creased portions of the terminal ends of the clamping sides 54, 56. In response to a sufficient applied force, the opposing inner surfaces of the clamping sides 54, 56 of the spine clamp 210 move away from one another from a closed state to an open state.

Referring back to FIG. 2, the tension sheet 220 operates to transmit an opening force to one or more spine clamps such as the spine clamps 210. The tension sheet 220 typically includes a substantially inelastic body, which may be formed of one or more of a wide variety of different material compositions such as a substantially inelastic polymeric compound and a substantially inelastic textile fabric. The tension sheet 220 has a central portion 68 and first and second side portions 70, 72. During assembly of the inside assembly 200, the central portion 68 of the tension sheet 220 is securely affixed within the holding volumes of the spine clamps 210 between the datum alignment member 230 and the inner surfaces of the spine clamps 210. In addition, the first and second side portions 70, 72 of the tension sheet 220 are attached to the front inside board 124*a* and the back inside board 124*b*, respectively. In this way, the tension sheet 220 is operable to transmit an opening force from the inside boards 124*a*, 124*b* to the clamping surfaces of the spine clamps 210.

The datum alignment member 230 operates to facilitate easy and proper alignment of the physical media 110 inside the media binder 100. In addition, the datum alignment member 230 operates to limit the marginal width of the physical media 110 captured by the spine clamps 210, which may result in a more aesthetically pleasing appearance. The datum alignment member 230 is secured together with the spine clamps 210 and the tension sheet 220 during assembly of the binding mechanism 122, and includes a spacer 74 and an integral datum stop 76. After assembly of the binding mechanism 122, the spacer 74 extends through the holding volumes of the spine clamps 210 and the spine clamps 210 are secured at spaced apart locations along the spacer 74. The spacer 74 has a planar datum surface 78 against which sheets of physical media 110 may be registered so that the opposite ends of the sheets present a clean edge to the user. The datum surface 78 also limits the insertion depth of the physical media 110 into the spine clamps 210 to reduce the marginal portions of the physical media 110 that are obscured by the binding mechanism 122. In this regard, the spacer 74 has a thickness that positions the datum surface 78 a desired height above the central portion 68 of the tension sheet 220 within the holding volumes of the spine clamps 210. The datum stop 76 is disposed at a distal end of the spacer 74. The datum stop 76 has a datum stop surface 80 that is orthogonal to the datum surface 78. The datum stop surface 80 provides a second edge against which the physical media 110 may be registered to achieve an aesthetically pleasing binding of the physical media 110 with aligned edges. A second datum stop may be provided at the opposite end of the spacer 74. The datum alignment member 230 typically is formed of a rigid material (e.g., a rigid plastic or metal material).

The inside boards 124*a*, 124*b* operate to facilitate proper alignment of the binding mechanism 122 in the media binder 100. Because the surface boards 132 function as levers in opening the binding mechanism 122, misalignment of the binding mechanism 122 may cause the media binder 100 difficult to operate. Thus, proper alignment of the binding mechanism 122 is important for the media binder 100 to function properly. However, for reasons such as customizing the binder cover, the media binder 100 may be assembled by low proficiency workforce at sites equipped with no or few specialized tools (e.g., a retailer site, home). As will be described in detail below and illustrated in FIG. 12, the inside boards 124 facilitate a simple and error-proof process for properly aligning the binding mechanism 122 in the media binder 100 that requires little training for the user conducting the assembly and few tools.

The inside boards 124 typically are formed of one or more layers of rigid material such as paperboard, metal, fabric, plastic, and a stiff polymeric material. The thickness of the inside board 124 may vary (e.g., between 0.01 inch and 0.20 inch) as desired. The inside boards 124 may be prepared (e.g., cut) such that the primary direction of fibers in the inside boards 124 (also called "fiber orientation", "grain direction") is orthogonal to the orientation of the spine of the media binder 100 (also called the "spine orientation"). This arrangement, together with setting the fiber orientations of the surface board 132 to be parallel to the spine orientation, prevents or reduces the warping effect on the binder covers while maintaining their stiffness.

The inside boards 124*a*, 124*b* are attached to the side portions 70, 72 of the tension sheet 220 in parallel to the spacer 74. The distance between the spine clamps 210 and the inside boards 124 as connected by the tension sheet 220 is important because it affects the operation range of the media binder 100 to open the binding mechanism 122 (e.g., the range of opening angles of the surface boards 132 when an opening force is applied to the spine clamps 210). Thus, the inside board 124 should be properly aligned with the binding mechanism 122 (e.g., parallel to the spacer 74) in the inside assembly to ensure that the media binder 100 has a desired operation range (e.g., opening angle between 270° and 360°). To ensure the proper alignment of the inside boards 124 and the binding mechanism 122, the internal assembly is pre-assembled at a manufacturing site by experienced manufacturing workers using specialized tools.

A layer of adhesive (e.g., pressure sensitive adhesive (PSA)) is placed on the outwardly facing surface of the inside boards 124 (i.e., the surface opposite to the inwardly facing surface attached to the tension sheet 220) with the release liners 128*a*, 128*b* placed on top to protect the adhesive for ease of transportation and storage. The release liners 128 may be formed of one or more materials including paper, fabric, and plastic. The release liners 128 are removed before the inside assembly 200 and the case assembly are combined using the adhesive (e.g., at the retailer site).

The alignment board 130 is added to the inside assembly 200 to facilitate proper alignment of the inside assembly 200 and the case assembly in the media binder 100. As shown, the alignment board 130 is a piece of rectangular board with a rectangular cavity in a corner. In one example, to facilitate simple and error-proof assembly of the media binder 100, the size of the alignment board 130 is set to be approximately the same as (or similar to) the cover size of the media binder 100 (e.g., the front cover), such that the alignment board 130 and the case assembly can be easily aligned when the inside assembly 200 and the case assembly are combined, thereby ensuring the proper alignment of the inside board 124 in the media binder 100. The alignment board 130 typically is formed of one or more layers of rigid material such as paperboard, metal, plastic, fiber, and a stiff polymeric material. During assembly of the inside assembly 200, the alignment board 130 is inserted into the binding mechanism 122 such that the alignment board 130 registers with the spacer 74 and the cavity registers with the datum stop 76.

The alignment board 130 can be used to align the inside assembly 200 with the case assembly, and can be removed and reused thereafter. The alignment board can have a special coating so that it can be passed through the laminator to clean the rolls after making books. The alignment board 130 maybe a flat board as shown in FIG. 2. Alternatively, the alignment board 130 may have thicker edges for fitting the inside boards 124 and the surface boards 132 inside the edges, and thereby facilitating easy alignment between the inside assembly 200 and the case assembly. Because the alignment board 130 provides the stiffness needed for handling the inside assembly 200, the inside boards of the inside assembly 200 may be thin and/or less rigid.

The paste downs 126*a*, 126*b* are attached to the inwardly facing surfaces of the inside boards 124*a*, 124*b*, respectively, for covering up the side portions 70, 72 of the tension sheet 220 attached to the inside boards 124, which may result in a more aesthetically pleasing appearance. In addition, the paste downs 126 also function to further secure the tension sheet 220 to the inside boards 124. The paste downs 126 are formed of a wide variety of different materials such as paper, plastic, metal, fiber, and film.

Figure 5:
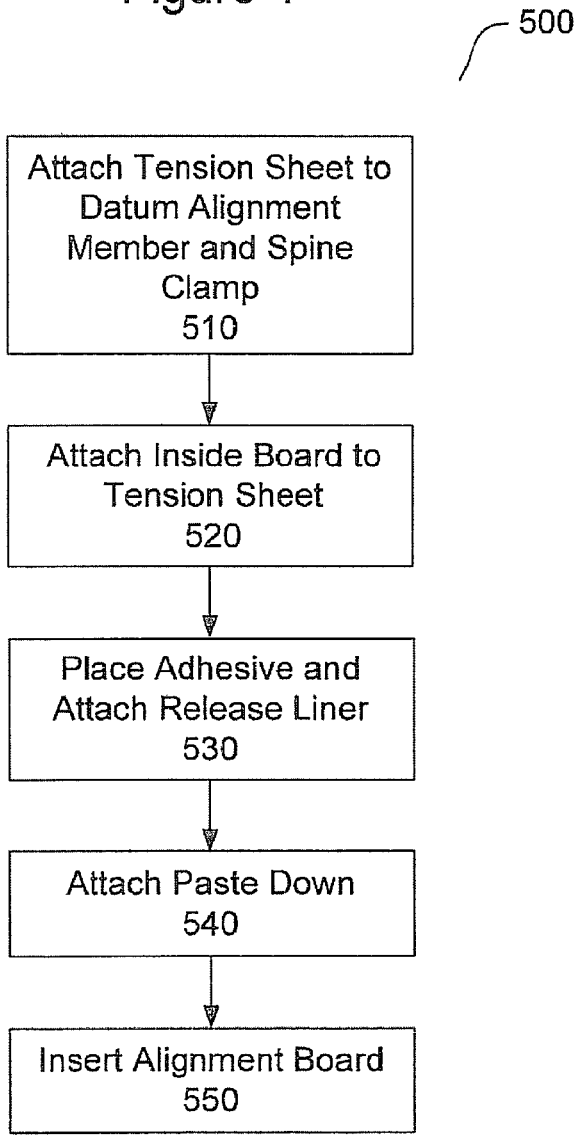
FIG. 5 is a flow diagram of an example method of manufacturing the example inside assembly shown in FIG. 2.

FIG. 5 shows an example method 500 of manufacturing the inside assembly 200, which is shown in FIGS. 2 and 3A-B. Other examples perform the steps in different orders and/or perform different or additional steps than the ones shown in FIG. 5.

In step 510, the central portion 68 of the tension sheet 220 and the spacer 74 of the datum alignment member 230 are attached to an interior cavity (i.e., the holding volume) defined by the spine clamps 210. The tension sheet 220 may be positioned in-between the spine clamps 210 and the datum alignment member 230. The spine clamps 210 may be attached to the spacer 74 by inserting a coupling member through respective holes in the spine clamps 210, by heat staking the spacer 74 to the spine clamps 210, or by mechanically interlocking engagement features of the spacer 74 with respective engagement features of the spine clamps 210.

In step 520, the side portions 70, 72 of the tension sheet 220 are attached to the inside boards 124*a*, 124*b*, respectively, over the clamp edge features 64, 66.

In step 530, a layer of adhesive (e.g., PSA) is placed on an outwardly facing surface of the inside boards 124*a*, 124*b* with release liners 128*a*, 128*b* placed on top to cover over the layer of adhesive.

In step 540, the paste downs 126*a*, 126*b* may be attached to the inside boards 124*a*, 124*b*, respectively, to cover over the portions of the side portions 70, 72 affixed to the inside boards 124*a*, 124*b*.

In step 550, the alignment board 130 is inserted into the binding mechanism 122 such that the alignment board 130 registers with the spacer 74 and the cavity registers with the datum stop 76.

As noted above, proper alignment of the inside assembly 200 is important to ensure that the media binder 100 functions properly. Accordingly, the method 500 may be practices in a manufacturing site by experienced manufacturing workers using specialized tools to ensure proper alignment.

Case Assembly

Figure 6:
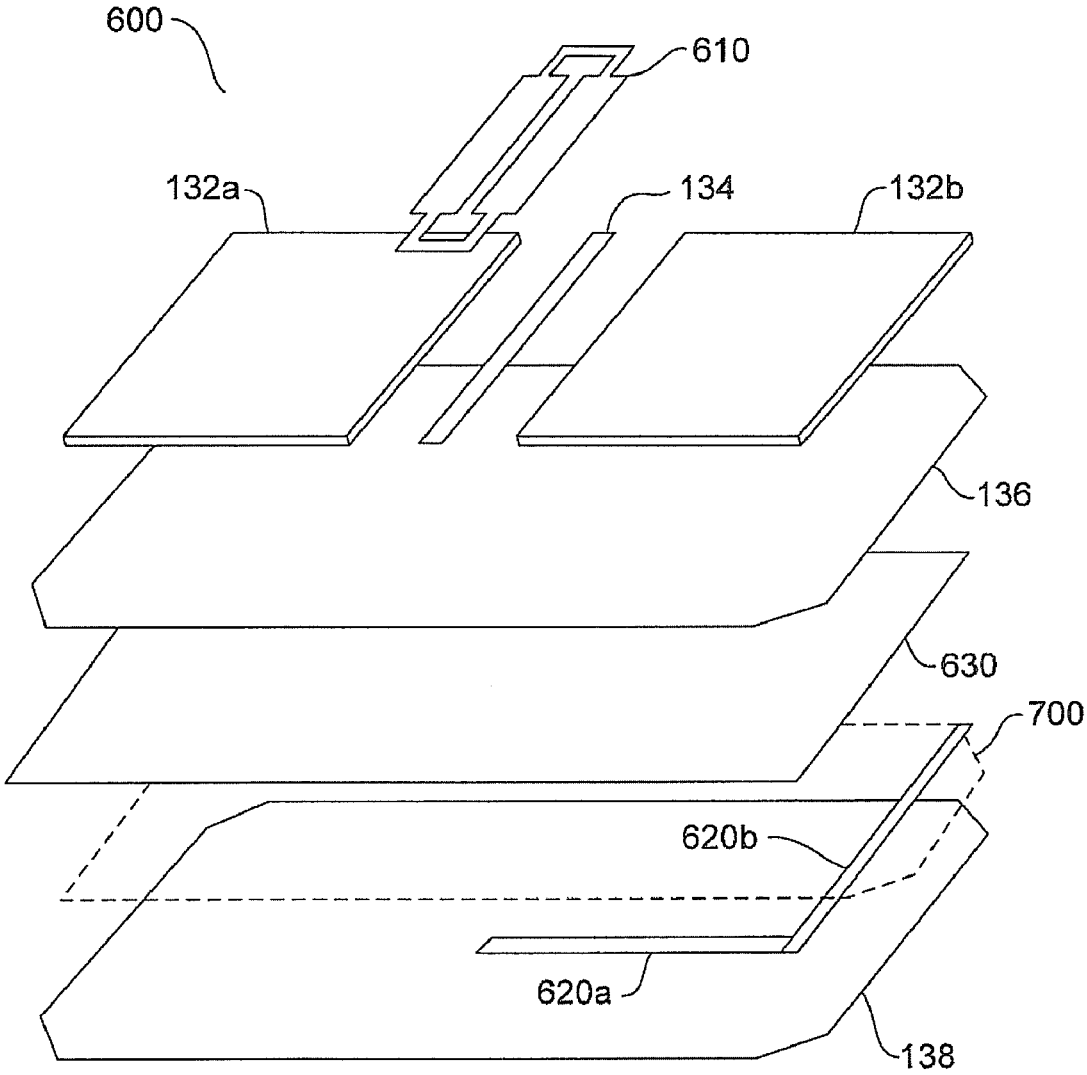
FIG. 6 is an exploded view of an example case assembly. Need to add the slip-sheet in this drawing
Figure 7A:
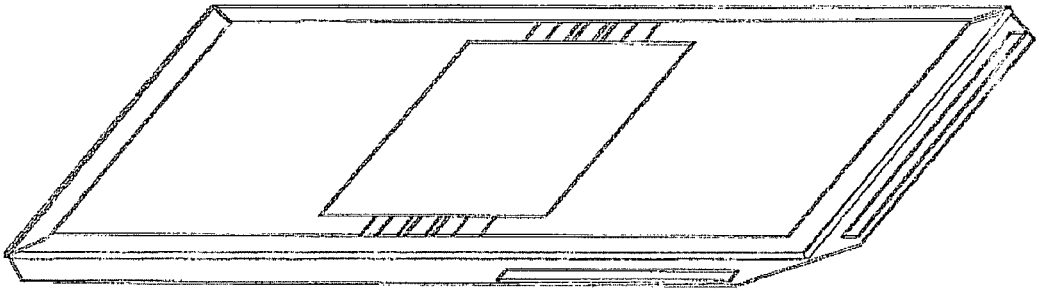
FIGS. 7A-D are various views of the example case assembly shown in FIG. 6.
Figure 7B:
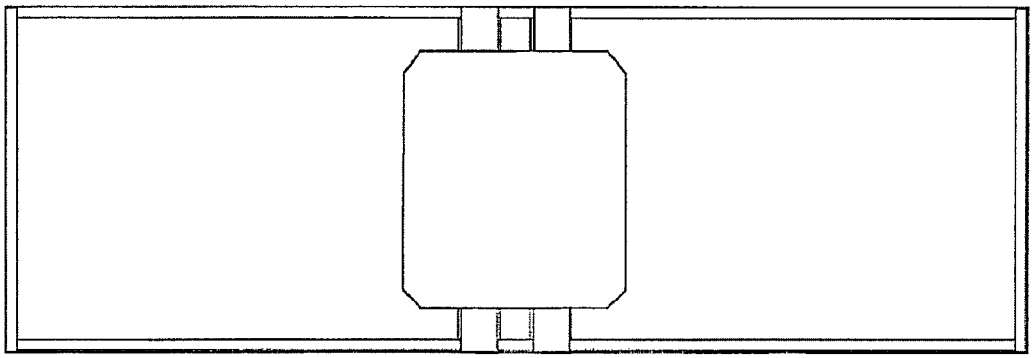
Figure 7C:
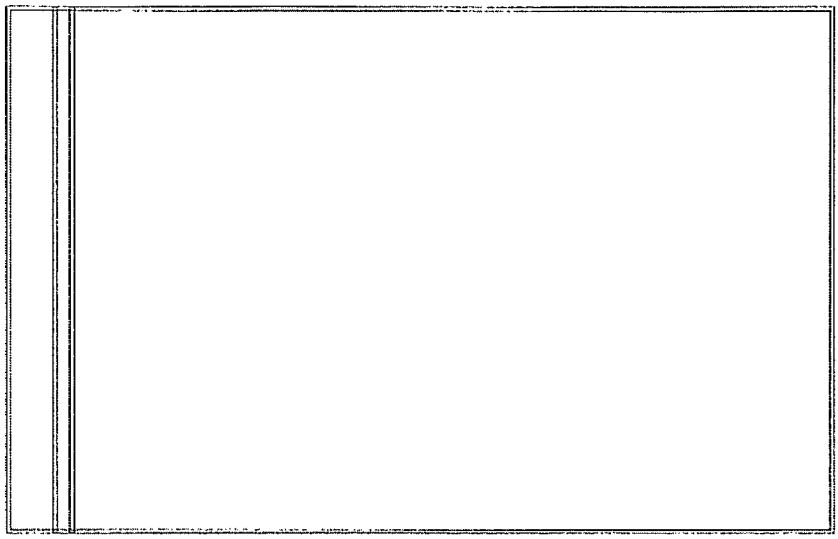
Figure 7D:
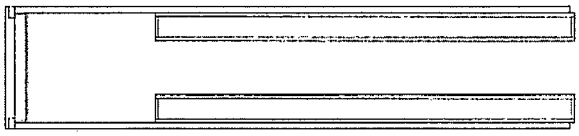
Figure 7E:
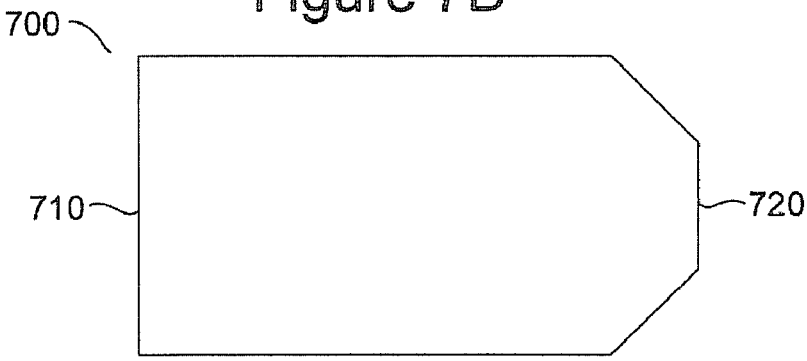
FIG. 7E shows a perspective view of an example slip-sheet.

FIG. 6 shows an exploded view of an example of a case assembly 600 that includes a spine surface board 134, a front surface board 132*a*, a back surface board 132*b*, a binding sheet 136, a layer of hot-melt adhesive 630, a cover sheet 138, and a spacer 610. FIG. 7A is a perspective view of the case assembly 600 assembled using the components shown in FIG. 6. FIG. 7B shows the inside of the case assembly 600 as it is laid open on a flat surface. FIGS. 7C and 7D show a front view and a cross section view of the case assembly 600 in a closed position, respectively. FIG. 7E shows a slip-sheet which may be placed between the cover sheet 138 and the binding sheet 136.

Referring now to FIG. 6, each of the surface boards 134, 132*a*, 132*b* may be formed of a durable material (e.g., a textile), a rigid planar material (e.g., paperboard, metal, plastic, fiber, or a stiff polymeric material), or one or more layers of such materials. One spine surface board 134 is illustrated to form a spine base of the media binder 100. In other examples, the spine base may include two or more spine surface boards 134.

The fiber orientations of the surface boards 132, 134 may be set to be parallel to the spine orientation of the media binder 100. This arrangement, together with setting the fiber orientations of the inside board 124 to be orthogonal to the spine orientation, prevents or reduces the warping effect on the binder covers while maintaining their stiffness. The thickness of the surface boards 132, 134 may vary (e.g., between 0.01 inch and 0.20 inch) as desired and is typically thicker than the inside boards 124.

The binding sheet 136 functions to bind the surface boards 132, 134 together and may be composed of material such as a substantially inelastic but flexible textile fabric or paper. The surface boards 132, 134 are attached to the outwardly facing surface of the binding sheet 136 using an adhesive. As illustrated, the binding sheet 136 wraps around the side edges such as the unbound edges (i.e., the side edges opposite to the spine) of the surface boards 132, 134. In other examples, the binding sheet 136 may or may not reach the side edges of the surface boards 132, 134. The layer of hot-melt adhesive 630 is placed on the inwardly facing surface of the binding sheet 136.

Figure 8A:
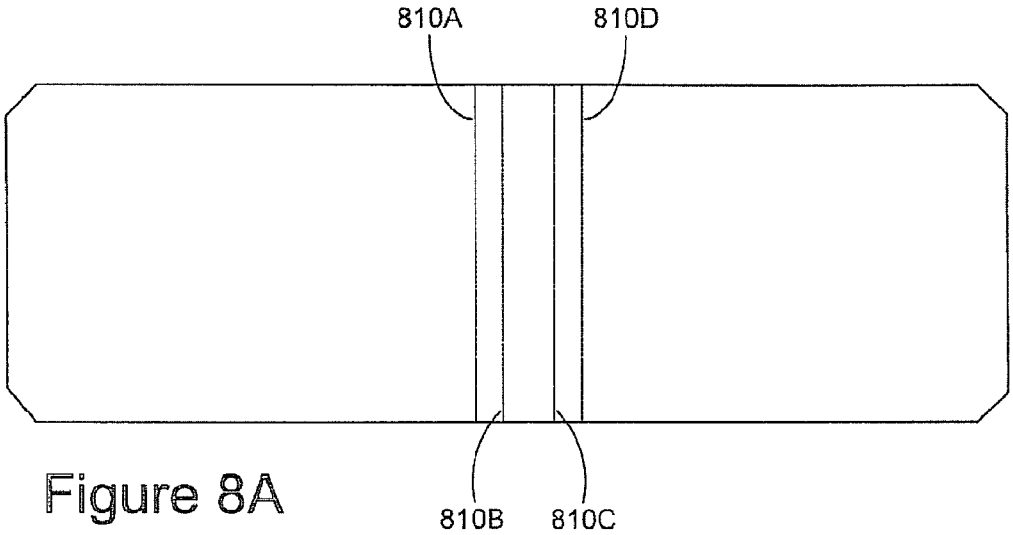
FIGS. 8A-E show examples that provide crease relief to a media binder.
Figure 8B:
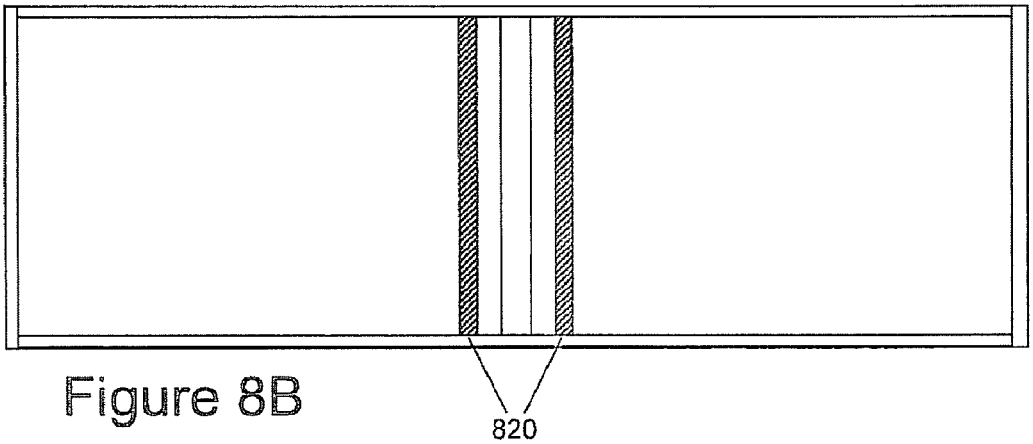
Figure 8C:
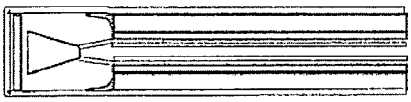
Figure 8D:
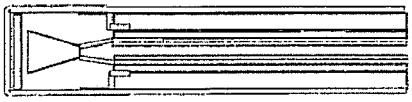
Figure 8E:
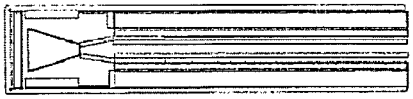

In one example, the binding sheet 136 is designed to facilitate the cover sheet 138 and/or a custom cover (e.g., a photo paper) to bend smoothly in the spine area and thereby preventing or reducing crease lines in the spine area. One such design is illustrated in FIG. 8A. As shown, the binding sheet 136 is processed to include perforation lines 810A-D parallel to the spine boards. The perforation lines 810 are approximate to the edges of the surface boards to create bending weak points that function to prevent or reduce sharp crease lines on the binding sheet 136, the cover sheet 138, and/or the custom cover inserted in between. For example, in the case assembly 600 the perforation lines 810A and 810D may be approximately 0.02 inch away from the inside edge of the front surface board 132*a* and the back surface board 132*b*, respectively; and the perforation lines 810B and 810C may be approximately 0.02 inch away from the vertical edges of the spine surface board 134. FIGS. 8B-E illustrates alternative/additional designs for providing crease relief. As shown in FIG. 8B, a strip of thin elastic material (e.g., plastic) 820 (also called a crease relief apparatus or a crease relief component) may be attached to the binding sheet 136 adjacent to the surface boards 132 to provide extra elasticity and support to the binding sheet 136. By distributing bending force on a small region of the binding sheet 136 (or the cover sheet 138, the custom cover) to a larger region (e.g., the region covered by the crease relief component), the crease relief component prevents or reduces crease lines. As shown in FIG. 8C, a strip of material (e.g., glue, plastic) may be applied to the corners formed by the binding sheet 136 and the inside edges of the surface boards 132. As shown in FIG. 8D, a strip of thin elastic material (e.g., plastic) may be partially attached to the binding sheet 136 adjacent to the surface boards 132 and partially affixed between the inside boards 124 and the surface boards 132. FIG. 8E illustrates another design for the strip of thin elastic material.

Referring back to FIG. 6, the cover sheet 138 wraps around the surface boards 132, 134 and the binding sheet 136 and functions to form a pocket for housing a custom cover and to protect the custom cover from damages (e.g., scratches) and/or degradation due to natural elements (e.g., light and water). The cover sheet 138 may be formed of a transparent (or semitransparent) material such as plastic, an acetate material and a single or composite polymeric film (e.g., polyethylene terephthalate (PET), polyvinyl chloride (PVC)). The marginal edges of the cover sheet 138 are folded over the side edges of the surface boards 132, 134. One or more of the folded marginal edges are affixed to the inwardly facing surfaces of the surface boards 132, 134 (also called "engaged edges", "attached edges"), while the remaining folded marginal edges are unattached (also called "unengaged edges", "unattached edges", "loose edges") and can be opened such that a custom cover (e.g., a sheet of photo paper) may be inserted in-between the binding sheet 136 and the cover sheet 138 through the opening. In an example, a removable slip-sheet 700 is placed between the binding sheet 136 and the cover sheet 138. The slip-sheet is illustrated in FIG. 7E. As shown, the slip-sheet 700 is a piece of rectangular sheet 710 with a handle 720 at one end. In another example, the slip sheet may be a piece of rectangular sheet 710 only. The rectangular sheet 710 portion of the slip-sheet 700 is placed below the cover sheet's inwardly facing surface and is approximately the same as the size of the case assembly 600. The handle 720 of the slip sheet 700 protrudes beyond the margin of the case assembly 600. The slip-sheet 700 may be formed of paper or plastic. The slip-sheet 700 functions to prevent the hot-melt adhesive 630 to stick to the hot-melt adhesive on the cover sheet 138 and to provide a guide during the insertion of the customized photo into the pocket. Optional features may be added to the slip-sheet such as assembly instruction text, die-cut windows to see the inserted photo, and edge cut-outs to aid the slip-sheet removal. In an instance, a customized cover is placed below the slip sheet 700 i.e. in-between the slip-sheet 700 and the binding sheet 136. Once the customized cover is placed, the slip-sheet 700 is removed from case assembly 600 by pulling the handle 720.

Adhesive strips (e.g., PSA) 620*a*, 620*b* may be placed on the inwardly facing surface of the surface boards 132 (or the binding sheet 136) that contact the unattached, folded marginal edges of the cover sheet 138 with strips of release liner covering the adhesive strips.

In one example, the marginal edge of the cover sheet 138 over the unbound edge of the back surface board 132*b*, along with a portion of the marginal edge over an adjacent side edge of the back surface board 132*b* are unattached. Two adhesive strips 620*a*, 620*b* are placed on the inwardly facing surface of the back surface board 132*b* corresponding to the loose edges. A layer of hot melt adhesive may be placed on the central area (e.g., the area surrounded by the marginal edges) of the inwardly facing surface of the cover sheet 138 or cover the entire inwardly facing surface for ease of manufacture.

Figure 9:
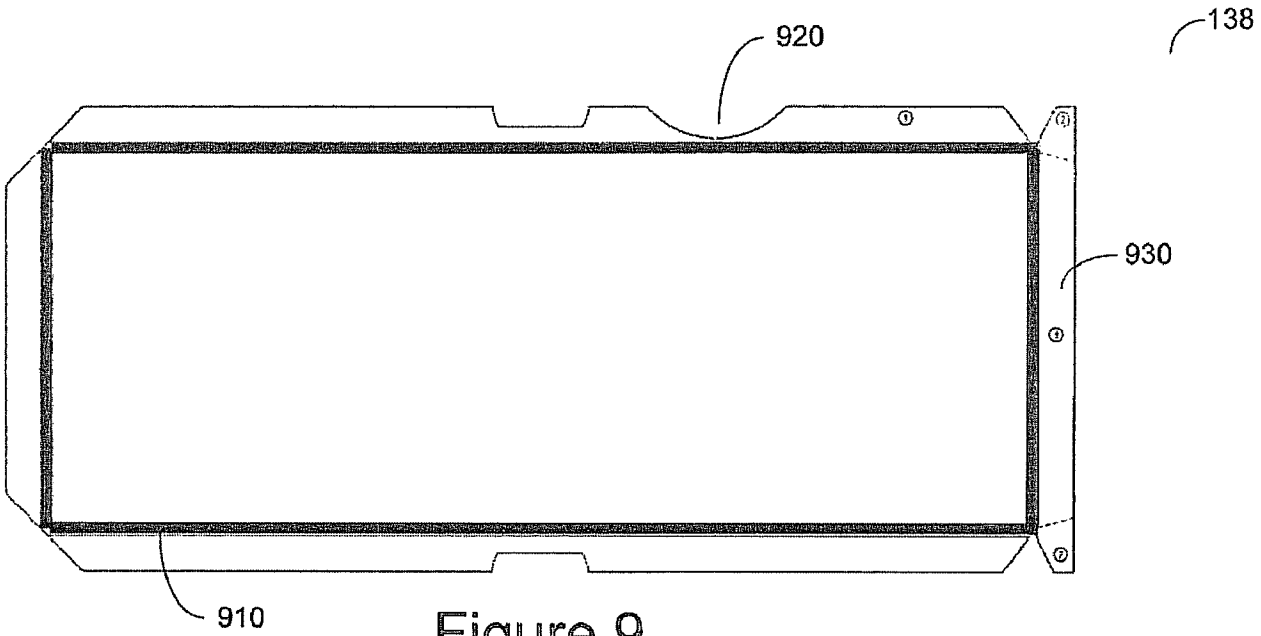
FIG. 9 shows an example cover sheet of the example case assembly shown in FIG. 6.

FIG. 9 illustrates the layout of the cover sheet 138 according to one example. As shown, the cover sheet 138 includes black borders 910 on the areas wrapping around side edges of the surface boards 132, 134. The marginal edges of the cover sheet 138 to be wrapped around the surface boards may vary in width—narrower in portions wrapped around the spine surface board 134 and the portion near the ends of the loose edges, for example. In one example, the portion of a side marginal edge that borders the engaged edge portion and the loose edge portion has an inward arc shape 920 that is the narrowest at the border point. As such, the loose edge portion forms a curve that functions to guide the custom cover into the pocket formed in between the cover sheet 138 and the binding sheet 136. In one example, one marginal edge of the surface coversheet is longer than the marginal edge of the at least one surface board. The ends of a loose edge 930 are designed to facilitate creating corner wraps after the customer cover is inserted into the pocket. Example designs of the loose edge ends and methods of creating a corner wrap are described in detail below and illustrated in FIGS. 14A-C.

The thickness of the cover sheet 138 may vary (e.g., between 0.001 inch to 0.020 inch) as desired but is typically thin enough to be wrapped around the side edges of the surface boards 132, 134 and to bend around the spine base, and is thick enough to be safely transported and handled, to reduce the likelihood of wrinkles if laminated, and to resist tearing during assembly and use. In one example, the cover sheet 138 is around 0.004 inch thick.

Figure 10A:
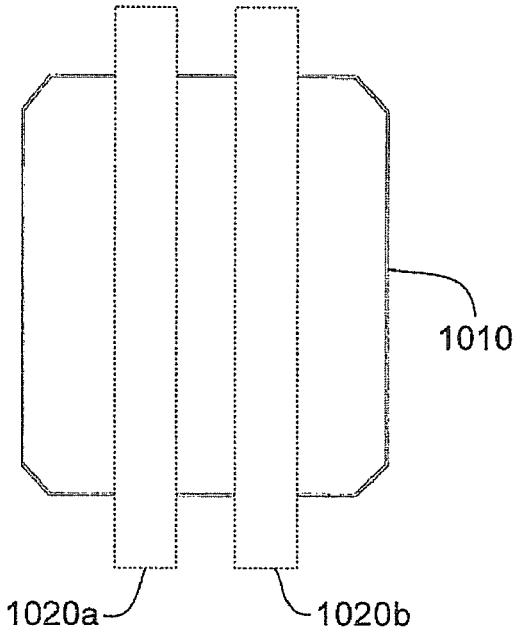
FIG. 10A shows an example spacer of the example case assembly shown in FIG. 6.
Figure 10B:
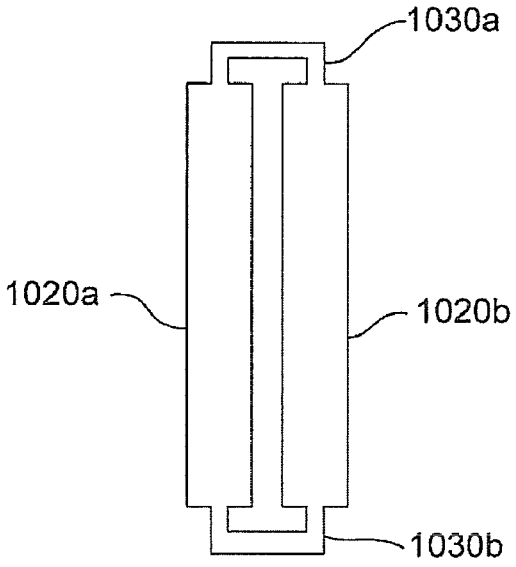
FIG. 10B shows an alternate example spacer of the example case assembly shown in FIG. 6.
Figure 11A:
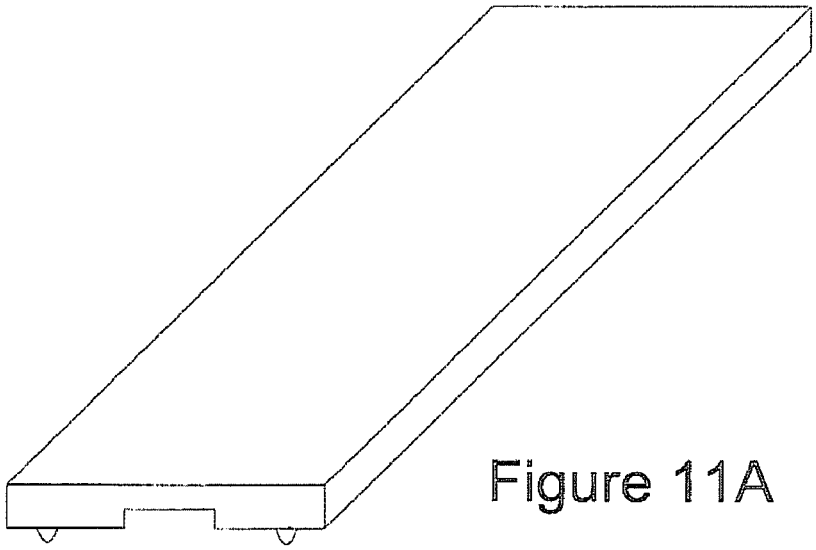
FIGS. 11A-B are various views of another example spacer for a case assembly.
Figure 11B:
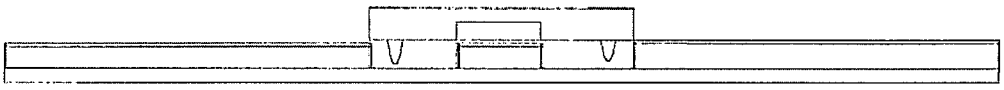

Referring back to FIG. 6, the spacer 610 is placed on the binding sheet 136 to fill the gaps formed between the spine surface board 134 and the front/back surface boards 132 such that the resulting the case assembly 600 has a relatively consistent thickness. As shown in FIG. 10A, a diagram illustrating the structure of an example spacer 610, the spacer 610 includes a spacer sheet 1010 and two spacer boards 1020*a*, 1020*b*. In an alternative example, as shown in FIG. 10B, the spacer 610 includes two spacer boards 1020*a*, 1020*b* connected to each other at their respective distal ends with connecting ridges 1030*a*, 1030*b*. In an example, the connecting ridges 1030*a*, 1030*b* extend beyond the surface boards 132 to facilitate a convenient removal of the spacer 610. The spacer sheet 1010 functions to bind the spacer boards 1020 and may be composed of material such as a substantially inelastic textile fabric, paper, or plastic. The spacer boards 1020 functions to fill in the gaps between the front/back surface boards 132 and the spine surface board 134 and may be formed of a durable material, a rigid planar material, or one or more layers of such materials. Comparing to the spacer boards 1020, the spacer sheet 1010 is relatively thin in thickness (e.g., between 0.001 inch to 0.020 inch, such as 0.006 inch). The thickness of the spacer boards 1020 is similar to the thickness of the surface boards 132, 134 (e.g., between 0.01 inch and 0.20 inch). In alternative examples, the spacer 610 may be unsegmented and/or include additional features, such as teeth for creating perforation lines on the binding sheet 136 that may prevent or reduce crease lines, as illustrated in FIGS. 11A-B.

Method of Creating a Media Binder with a Customized Cover

Figure 12:
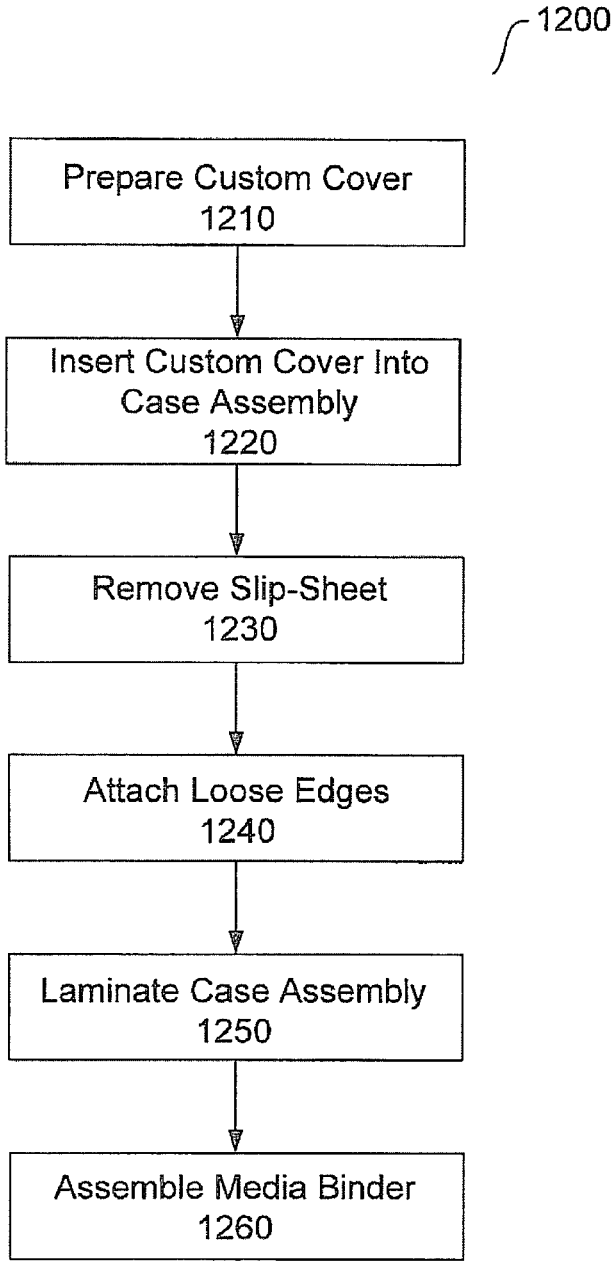
FIG. 12 is a flow diagram of an example method of customizing a case cover and finalizing a media binder.

FIG. 12 shows an example of a method 1200 of creating a media binder 100 with a customized case cover from the inside assembly 200 and the case assembly 600, which are shown in FIGS. 2-3B and FIGS. 6-7D, respectively. Other examples perform the steps in different orders and/or perform different or additional steps than the ones shown.

In step 1210, a custom cover is printed and, if needed, cut to a desired size and shape that can fit in the case assembly 600, which is preassembled at the manufacturing site.

In step 1220, the custom cover is inserted in-between the binding sheet 136 and the cover sheet 138 of the case assembly 600 through the opening formed by the loose edges of the cover sheet 138 and aligned with the surface boards 132, 134. Since the cover sheet 138 is pre-attached to the surface boards 132, 134 through the engaged edges, the alignment is simple and error-proof.

In step 1230, the slip-sheet 700 is removed from the case assembly 600.

In step 1240, the loose edges are wrapped around a corresponding surface board (e.g., the back surface board 132*b*) and attached to the surface board using an adhesive (e.g., PSA). The loose edge ends are wrapped to create a corner wrap. Example methods of creating a corner wrap are described in detail below and illustrated in FIG. 14A-C.

In step 1250, the case assembly 600 is passed through hot rollers (e.g., hot rollers of a laminating device) to bind the custom cover together with the cover sheet 138 and/or the binding sheet 136, and thereby forms a finished binder cover appearance. As noted above, a layer of hot melt adhesive was placed on the inwardly facing surface of the cover sheet 138 and/or the outwardly facing surface of the binding sheet 136. The heated rollers activate the hot melt adhesive to bind the custom cover to the cover sheet 138 and/or the binding sheet 136. The heated rollers may also bind the loose edges to the surface boards 132, 134. The spacer 610 is removed after the case assembly 600 is passed through the hot rollers.

Figure 13A:
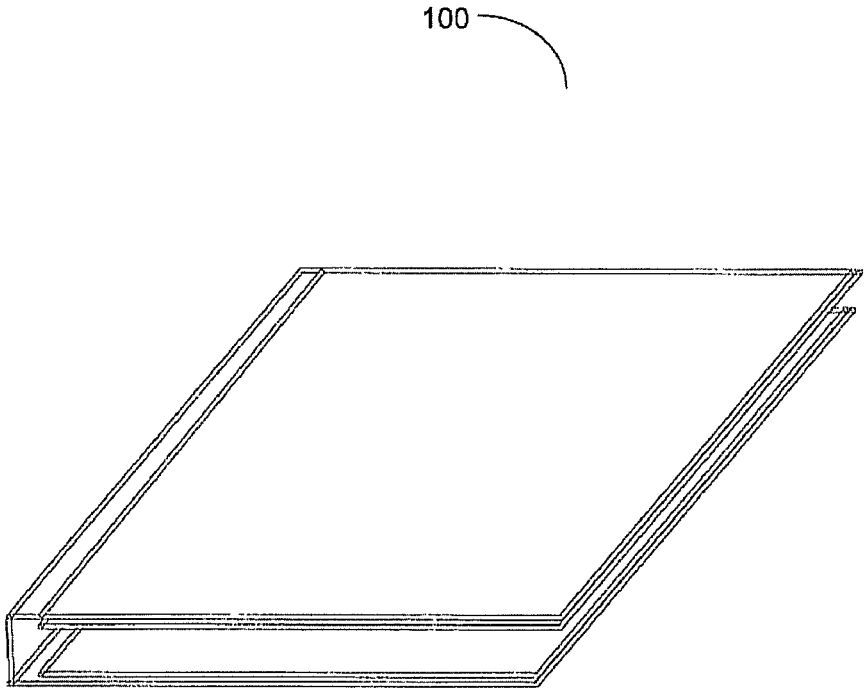
FIGS. 13A-B are various views of the media binder created using the example method shown in FIG. 12.
Figure 13B:
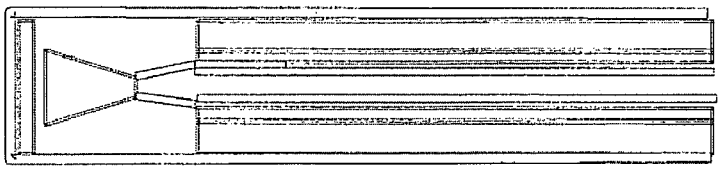

In step 1260, the inside assembly 200 and the case assembly 600 are combined to complete the media binder 100. In one example, a cover (e.g., the front cover) of the case assembly 600 is placed into an assembly frame. The inside dimension of the assembly frame is designed to facilitate proper alignment between the inside assembly 200 and the case assembly 600, and is approximately the same as the covers of the case assembly 600 and the alignment board 130 of the inside assembly 200. One example of the assembly frame includes four L shape corner pieces that collectively define the four corners of the assembly frame. Another example includes two L shape corner pieces that defines two diagonal corners of the assembly frame. The assembly frame typically includes an elastic body, which may be formed of one or more of a wide variety of different material compositions such as an elastic polymeric compound (e.g., plastic foam). The release liners on the inside assembly 200 are removed and the inside assembly 200 is placed into the assembly frame such that the outwardly facing surface of the inside boards 124 become attached to the inwardly facing surfaces of the surface boards 132 using adhesive on the inside boards 124. As a result, the media binder 100 is properly aligned, robust, and has a professionally finished and aesthetically pleasing appearance. FIGS. 13A and 13B illustrate a perspective view and a cross sectional view of the media binder 100 assembled using the method 1200, respectively.

Because the inside assembly 200 and the case assembly 600 can be pre-assembled at manufacturing sites to facilitate easy customization, error-proof alignment, and simple assembly, the process 1200 has relatively few steps, all of which are relatively easy to perform and requires few special tools, and thus reduces mistakes that may happen during the assembly. As a result, the method 1200 may be practiced by low proficiency workforce at sites equipped with few specialized tools (e.g., a retailer site, home). The method 1200 may be applied to customize and/or assemble any binding solution that includes a case, and not necessarily to the examples of internal assembly and/or case assembly described herein. For example, the binding mechanism 122 can use perfect binding, stapling, stitching, or any other binding mechanism.

Corner Wrapping

Figure 14A:
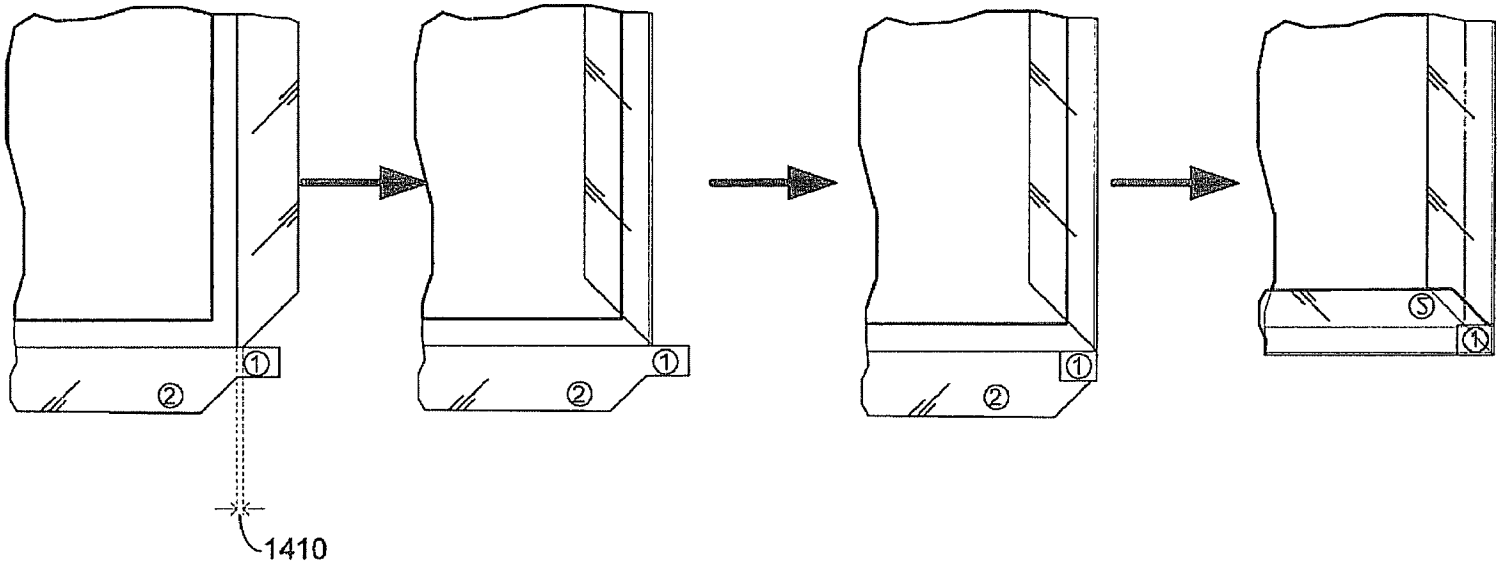
FIGS. 14A-C show examples that create corner wraps for a media binder.
Figure 14B:
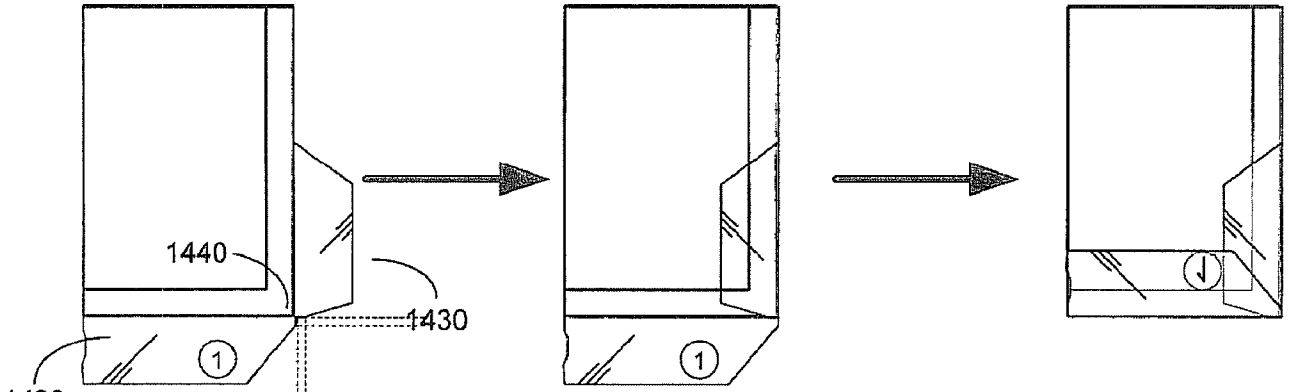
Figure 14C:
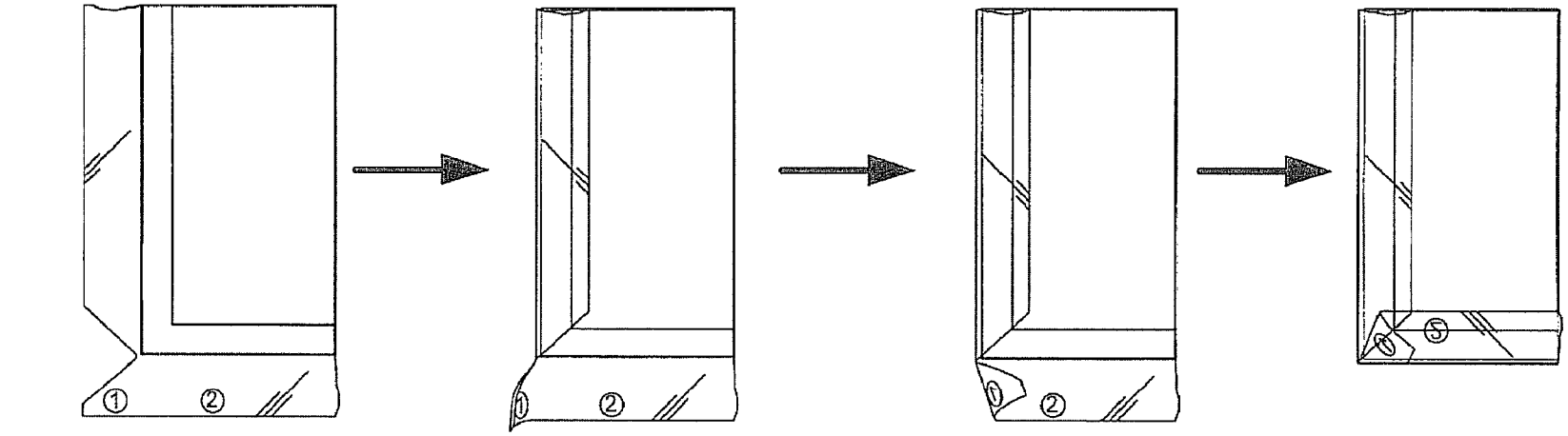

FIGS. 14A-C are diagrams that illustrate example designs of loose edge ends and methods for creating corner wraps using such designs. Corner wraps with professionally finished and aesthetically pleasing appearances can be created using these designs by low proficiency workforce at sites equipped with no specialized tools.

Referring now to FIG. 14A. As shown, the loose edge end includes a rectangular shaped extra edge that extends from the edge end. There is also an end edge 1410 between the strip and the neighboring edge. The length of the end edge 1410 is greater than the thickness of the surface board 132. In order to create a corner wrap, the neighboring edge is first attached (maybe in manufacturer site) to the surface board 132. The extra edge is folded backward to overlay the loose edge (maybe in retail site), and the loose edge is then folded over to be attached to the surface board 132. To facilitate the creation of the corner wrap, the extra edge is labeled "1" and the loose edge is labeled "2", indicating their operational sequence.

Referring now to FIG. 14B. As shown, a loose marginal edge 1420 and a neighboring marginal edge 1430 both have an end edge near the end. The lengths of the end edges are approximately the same as the thickness of the surface board 132. A strip (e.g., of the same composition/material as the cover sheet 138) may be attached to the corner 1440 of the surface board 132 before the two marginal edges 1420, 1430 are attached to the surface board 132 to create the corner wrap.

Referring now to FIG. 14C. As shown, similar to the design shown in FIG. 14A, the loose edge includes an extra edge that extends from the edge end. Unlike the design shown in FIG. 14A, the loose edge does not have an end edge that resembles the thickness of the surface board. After the neighboring marginal edge is attached, the extra edge can be wrapped inward to overlay the loose edge without overlaying the surface board, and the loose edge is then folded over to attached to the surface board and thereby creating the corner wrap.

Media Binder Using a Partial Printed Cover

Figure 15A:
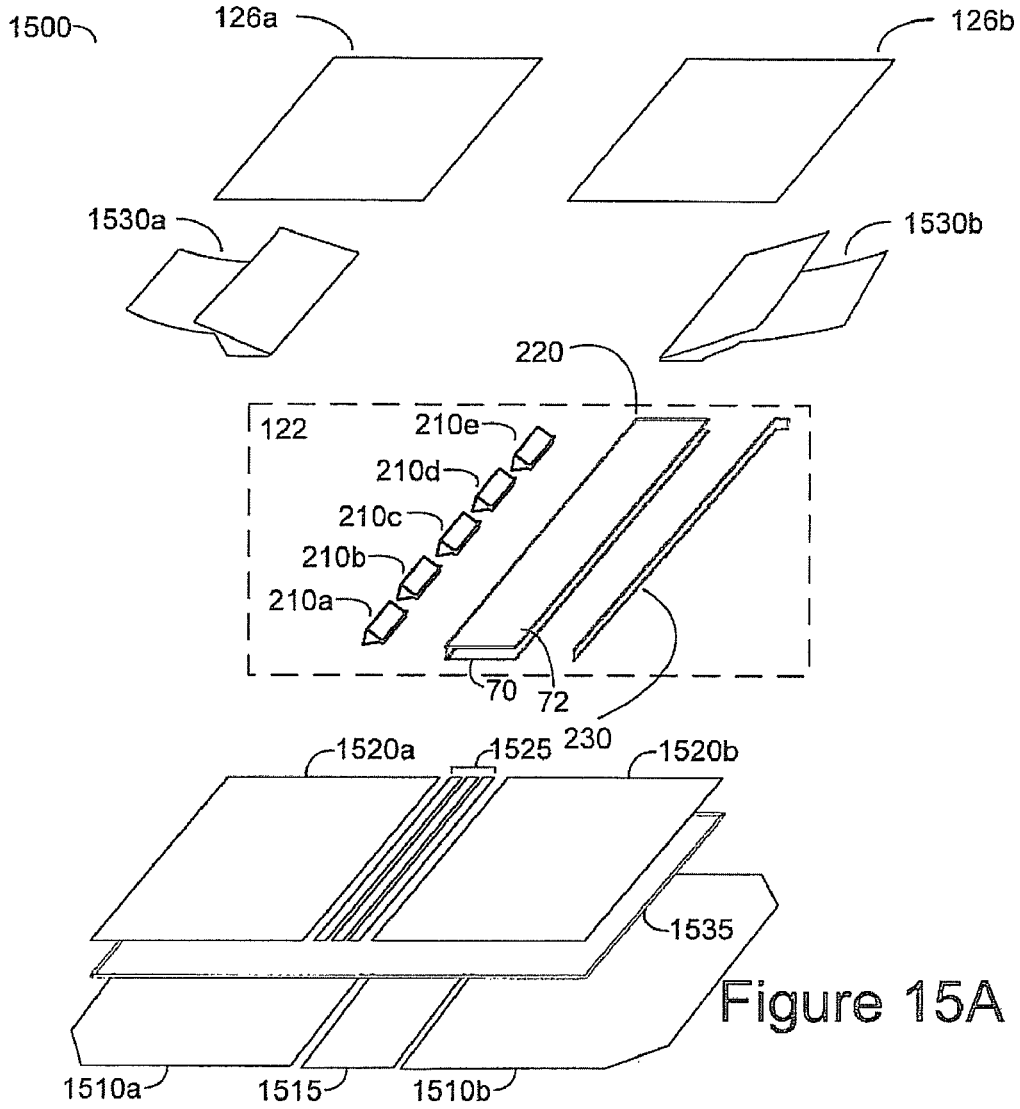
FIGS. 15A-B are various views of another example media binder.
Figure 15B:
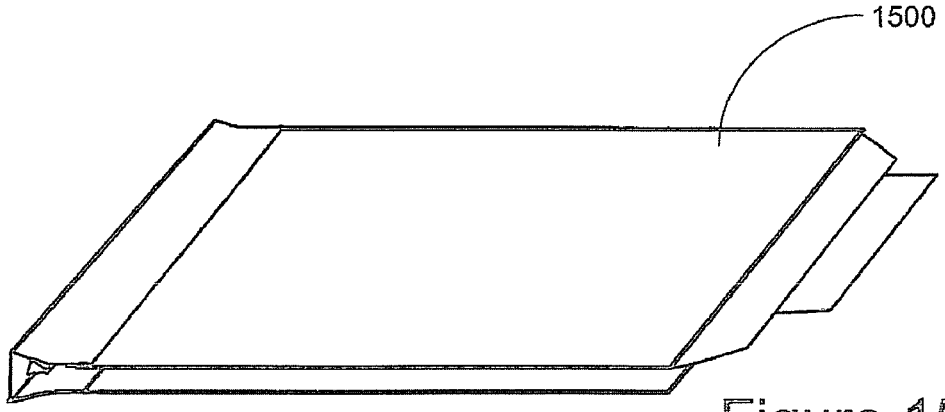

FIG. 15A shows an exploded view of an example of a media binder 1500 that uses a partial printed cover. In this example, the cover and the binding mechanism are pre-assembled into a single-piece media binder 1500 at a manufacturing site. The single-piece media binder 1500 has one or more pockets that enable the creation of a full cover customization at a client site (e.g., retailer site). Because components are aligned and pre-assembled at the manufacturing site, the process to customize the cover and finalize the media binder 1500 at the client site is simple. FIG. 15B is a perspective view of the media binder 1500 assembled using the components shown in FIG. 15A.

As shown in FIG. 15A, the media binder 1500 includes a cover layer, a binding sheet layer, a surface board layer, a binding mechanism 122, a release liner layer, and a paste down layer. The surface board layer includes a front surface board 1520*a*, a back surface board 1520*b*, and one or more spine surface boards 1525. The surface boards 1520, 1525 may be formed of a durable material (e.g., a textile), a rigid planar material (e.g., paperboard, metal, plastic, fiber, or a stiff polymeric material), or one or more layers of such materials, and may have a thickness between 0.01 inch and 0.20 inch. The binding sheet layer includes a binding sheet 1535 that functions to bind the surface boards 1520, 1525 together and may be composed of material such as a substantially inelastic textile fabric, or paper.

The cover layer includes a front cover sheet 1510*a*, a back cover sheet 1510*b*, and a spine wrap 1515. The spine wrap 1515 attaches to the outwardly facing surface of the spine surface boards 1525 and adjacent portions of the surface boards 1520 (e.g., using an adhesive) and wraps around the side edges of the surface boards 1520, 1525 (e.g., by 0.08 inch or more) to ensure strong adhesion. The spine wrap 1515 may be formed of a durable material (e.g., a textile, plastic, organic such as leather).

The cover sheets 1510*a*, 1510*b* wraps around the side edges of the surface boards 1520*a*, 1520*b*, respectively. The cover sheets 1510 may be formed of a transparent material such as an acetate material and a single or composite polymeric film, and may have a thickness between 0.001 inch and 0.015 inch (e.g., 0.003 inch). One or two of the marginal edges of the cover sheets 1510 are wrapped around the side edges of the surface boards 1520 and pre-attached to the inwardly facing surface of the surface boards 1520 (e.g., using an adhesive), leaving the remaining edges loose for inserting a custom cover through the opening. The remaining marginal edges of the cover sheets 1510 (the "loose edges") may be loosely attached to the surface boards 1520 using an adhesive strip capable of repeated open and closure placed on the surface boards 1520, and can be readily re-opened and/or re-attached. As illustrated, the loose edge is the unbound edge (i.e., the side edge opposite to the spine). Alternatively or additionally, the loose edges may also include the top edge, and/or the bottom edge. The spine wrap 1515 may overlap the cover sheets 1510 by attaching to a portion of the outwardly facing surface of the cover sheets 1510 (e.g., by 0.008 inch or more) to both hold the cover sheets 1510 in place and to provide a margin of error where a custom cover may be slide under.

The binding mechanism 122 includes one or more spine clamps such as spine clamps 210*a*, 210*b*, 210*c*, 210*d*, 210*e*, a tension sheet 220, and a datum alignment member 230. The datum alignment member 230 is secured together with the spine clamps 210 and the tension sheet 220 during assembly of the binding mechanism 122. The side portions 70, 72 of the tension sheet 220 are attached to the inwardly facing surface of the surface boards 1520*a*, 1520*b*, respectively.

The paste down layer includes a front paste down 126*a* and a back paste down 126*b*, and functions to cover up the portions of the tension sheet 220 attached to the surface boards 1520 and to securely bind the loose edges of the cover sheets 1510 to the surface boards 1520 once the binder cover is customized. During assembly, portions of the paste downs 126 close to the binding edge (e.g., adjacent to the spine) are attached to the surface boards 1520 to cover up the portions of the tension sheet 220 attached to the surface boards 1520. The remaining portions of the paste downs 126 (e.g., away from the spine) remain unattached from the surface boards 1520. A layer of adhesive is placed on the portions of the paste downs 126 unattached to the surface boards 1520*a*, 1520*b* with sheets of release liner (also called a "backing for paste down adhesive") 1530*a*, 1530*b* placed on top to cover the adhesive for ease of storage, operation, and transportation. The release liner 1530*a*, 1530*b* also have handles for ease of removal, as illustrated in FIG. 15B. The handles of the release liner 1530 may be folded around the paste downs 126*a*, 126*b*, respectively, for ease of transportation and handling. The paste downs 126 are formed of any number of mediums such as papers and films.

Figure 16:
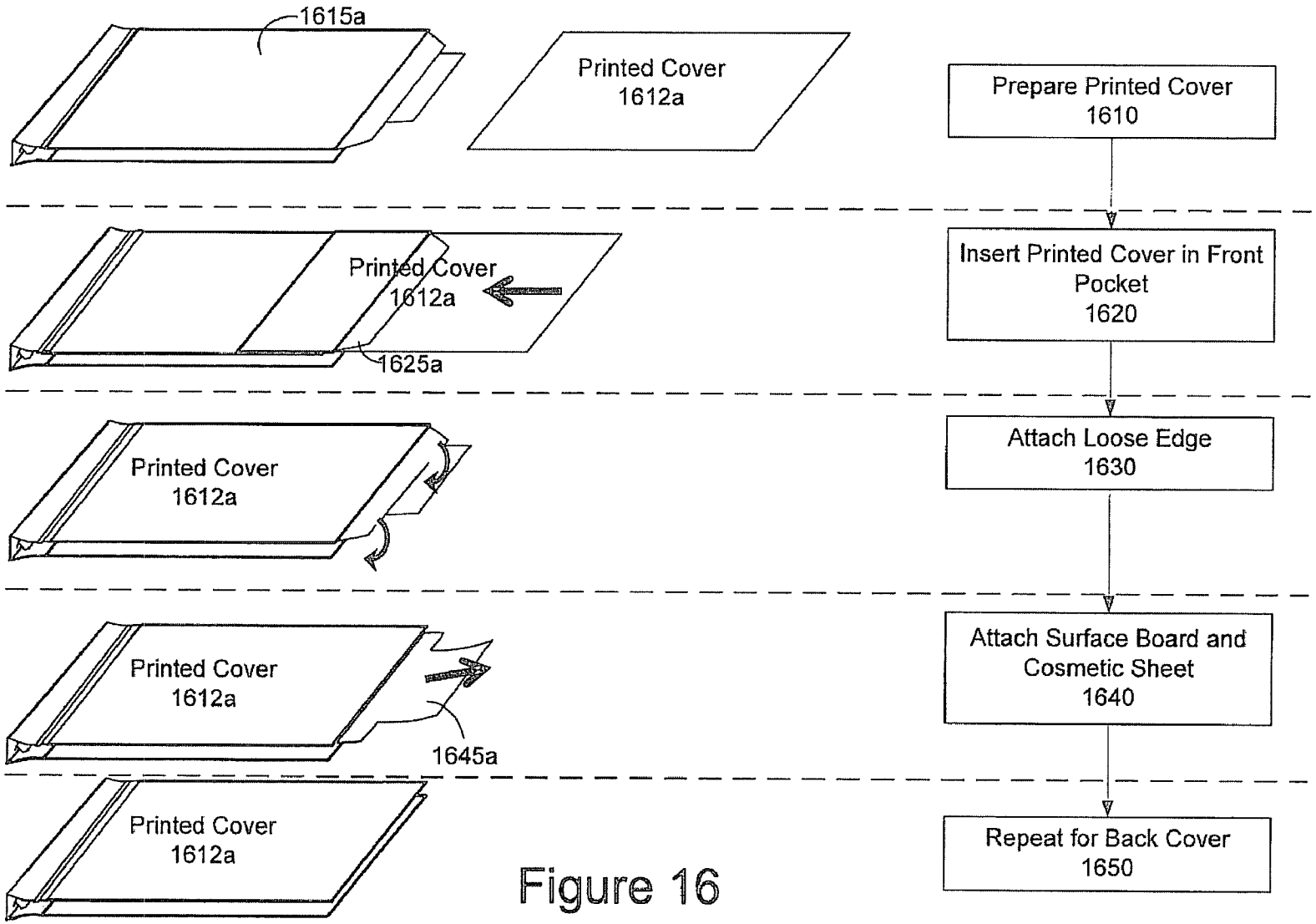
FIG. 16 is a flow diagram of an example method of customizing case covers and finalizing the example media binder shown in FIG. 15A.

FIG. 16 shows an example of a method 1600 of customizing case covers and finalizing the media binder 1500, which is shown in FIG. 15B. Other examples perform the steps in different orders and/or perform different or additional steps than the ones shown in FIG. 16.

In step 1610, a front cover 1612*a* is printed and, if needed, cut to a desired size and shape that can fit into a front pocket 1615*a* of the media binder 1500, which is preassembled at the manufacturing site.

In step 1620, the loose edge 1625*a* of the front cover sheet 1510*a* is opened and the printed front cover 1612*a* is inserted into the front pocket 1615*a* from the resulting opening.

In step 1630, the loose edge 1625*a* is wrapped around the front surface board 1520*a* and attached to the surface board 1520*a* using the adhesive strip on the surface board 1520*a*.

In step 1640, the release liner 1530*a* is removed from the front paste down 126*a* (e.g., by pulling the handle 1645*a*) and the unattached portion of the front paste down 126*a* is attached to the front surface board 1520*a* using the adhesive on the front paste down 126*a*.

In one example, the paste down 126*a* is formed of a rigid planar material (e.g., paperboard or a stiff polymeric material). In this example, the layer of adhesive and the release liner 1530*a* covering the adhesive are optional, and, if they are not present, the loose edge 1625*a* may be simply inserted in between the front surface board 1520*a* and the paste down 126*a*. As a result, in this example, the user may replace the front cover 1612*a* in the front pocket 1615*a* whenever desired.

In step 1650, the steps 1610 through 1640 are repeated for the back cover to fully customize the case cover and finalize the media binder 1500. Because the cover sheets 1510 are wrapped around the surface boards on the top, bottom, and unbound edges, the finished media binder 1500 forms a finished binder cover appearance.

A layer of hot melt adhesive may be placed on the inwardly facing surfaces of the cover sheets 1510 and/or the outwardly facing surfaces of the binding sheet 1535, and the media binder 1500 may be passed through a laminating device to bind the printed covers to the cover sheets 1510 and/or the surface boards 1520. The media binder 1500 may be passed through in a closed position with an insertion (e.g., the alignment board 610) to ensure a constant thickness of the media binder 1500 relative to the spine. Alternatively, the media binder 1500 may be passed through the laminating device without the insertion, or be fed into the laminating device from the unbound edge up to the spine wrap 1515 in an open position or a closed position.

The method 1600 is easy and does not require specialized tools for the customization, thus may be practiced by low proficiency workforce at sites equipped with no or few specialized tools (e.g., a retailer site, home). In addition, the printed covers used to customize the media binder 1500 are typically smaller than the printed covers used to customize the media binder 100, and thus may be printed using smaller printers that are more common at retailer sites and home environment.

In examples described herein, colorful borderlines (e.g., black) may be placed on the cover sheet (e.g., the cover sheets 138, 1510) on areas wrapping around side edges of the surface boards. The borderlines can serve to hide the underlying material at the side edge, and if the borderlines extend to cover the outwardly facing surface of the surface boards, to cover skew in the printed cover placed behind the cover sheets. For example, a thin black border (e.g., extending 0.04 inch to 0.20 inch in thickness from the side edges) can be painted on the inside of the cover sheets 1510 to cover any misalignment of the printed covers inserted behind.

One skilled in the art will recognize that the configurations and methods described above and illustrated in the figures are merely examples, and that the described subject matter may be practiced and implemented using many other configurations and methods. It should also be noted that the language used in the specification has been principally selected for readability and instructional purposes, and may not have been selected to delineate or circumscribe the inventive subject matter. Accordingly, the disclosure of the described subject matter is intended to be illustrative, but not limiting, of the scope of the subject matter, which is set forth in the following claims.

What is claimed is:

1. A case assembly of a media binder, comprising:

surface boards including a front surface board, at least one spine board and a back surface board, wherein each surface board comprises an inwardly facing surface and an outwardly facing surface;

a binding sheet comprising an inwardly facing surface and an outwardly facing surface, wherein the inwardly facing surface of the binding sheet attaches to the outwardly facing surfaces of the surface boards, the binding sheet comprising perforation lines parallel to the spine board and proximate to edges of the surface boards; and a cover sheet wrapped around the outwardly facing surface of the binding sheet and comprises a first marginal edge wrapped around one of the surface boards and unattached to the inwardly facing surface of the one of the surface boards, the cover sheet also comprises a second marginal edge partially attached to the inwardly facing surface of the one of the surface boards, wherein the portion of the second marginal edge unattached to the inwardly facing surface of the one of the surface boards is adjacent to the first marginal edge.

2. The case assembly of claim 1, wherein a surface of the cover sheet facing the surface boards comprises a layer of hot melt adhesive, and the outwardly facing surface of the surface boards comprises a layer of hot melt adhesive.

3. The case assembly of claim 1, wherein the cover sheet comprises a borderline, approximate to a marginal edge of the cover sheet, placed inside of the coversheet.

4. The case assembly of claim 1, wherein the inwardly facing surface of the one of the surface boards comprises an adhesive strip facing the first marginal edge.

5. The case assembly of claim 1, wherein the outwardly facing surface of the binding sheet comprises a layer of hot melt adhesive.

6. The case assembly of claim 5, further comprising a removable slip-sheet placed between the binding sheet and the cover sheet.

7. The case assembly of claim 1, further comprising a removable spacer to fill a gap formed between the at least one spine board and the at least one surface board.

8. A case assembly of a media binder, comprising:

a front surface board and a back surface board, wherein each surface board comprises an inwardly facing surface and an outwardly facing surface;

a binding sheet comprising an inwardly facing surface and an outwardly facing surface, wherein the inwardly facing surface of the binding sheet attaches to the outwardly facing surface of the surface board, the binding sheet comprising perforation lines parallel to the spine board and proximate to edges of the surface board; and at least one cover sheet, wherein each cover sheet is wrapped around the outwardly facing surface of the binding sheet, and comprises at least one marginal edge attached to the inwardly facing surface of the surface board, and comprises at least one marginal edge unattached to the inwardly facing surface of the surface board, wherein an end of the unattached marginal edge comprises an extra edge extended from the unattached marginal edge, the extra edge is folded against the unattached marginal edge and the unattached marginal edge is attached to the inwardly facing surface of an adjacent surface board to form a corner wrap around a corner of the adjacent surface board.

9. The case assembly of claim 8, wherein the extra edge comprises a strip of cover sheet unattached to the corner of the adjacent surface board.

10. The case assembly of claim 9, wherein an end of a marginal edge adjacent to the end of the unattached marginal edge comprises an end edge parallel to the unattached marginal edge, the length of the end edge is greater than a thickness of the adjacent surface board.

11. The case assembly of claim 8, wherein a first symbol is marked on the extra edge, and a second symbol is marked on a different portion of the unattached marginal edge.

12. A media binder, comprising:

surface boards including a front surface board, at least one spine surface board, and a back surface board, wherein each surface board comprises an inwardly facing surface and an outwardly facing surface;

at least one binding sheet attached to the inwardly facing surfaces of the surface boards, wherein a binding sheet comprises a component that distributes a bending force on a first region of the binding sheet to a second region of the binding sheet, the second region being larger than the first region, and the binding sheet comprising perforation lines parallel to the spine board and proximate to edges of the surface boards; and at least one cover sheet, wherein each cover sheet is wrapped around the outwardly facing surface of the at least one binding sheet, and comprises at least one marginal edge attached to the inwardly facing surface of the surface board, and comprises at least one marginal edge unattached to the inwardly facing surface of the surface board, wherein an end of the unattached marginal edge comprises an extra edge extended from the unattached marginal edge, the extra edge is folded against the unattached marginal edge and the unattached marginal edge is attached to the inwardly facing surface of an adjacent surface board to form a corner wrap around a corner of the adjacent surface board.

13. The media binder of claim 12, wherein the component comprises a strip of elastic material attached to the binding sheet.

14. The media binder of claim 13, wherein the strip is in-between two surface boards and parallel to an edge of each of the two surface boards.

15. The media binder of claim 13, wherein the strip is attached to at least one of the surface boards.

16. The media binder of claim 12, further comprising a printed cover in between the at least one cover sheet and the at least one surface board.

17. The media binder of claim 16, wherein the component distributes a bending force on a third region of the printed cover to a fourth region of the printed cover, the fourth region being larger than the third region.

* * * * *